US009267646B2

(12) United States Patent
Knausdorf et al.

(10) Patent No.: US 9,267,646 B2
(45) Date of Patent: Feb. 23, 2016

(54) SYSTEMS AND METHODS FOR INK-BASED DIGITAL PRINTING USING A VAPOR CONDENSATION DAMPENING FLUID DELIVERY SYSTEM

(71) Applicant: Xerox Corporation, Norwalk, CT (US)

(72) Inventors: Peter J. Knausdorf, Henrietta, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/727,566

(22) Filed: Dec. 26, 2012

(65) Prior Publication Data

US 2014/0174310 A1 Jun. 26, 2014

(51) Int. Cl.

| | |
|---|---|
| ***B41L 23/00*** | (2006.01) |
| ***F17D 1/20*** | (2006.01) |
| ***B41F 7/24*** | (2006.01) |
| ***B41F 7/30*** | (2006.01) |

(52) U.S. Cl.

CPC ... *F17D 1/20* (2013.01); *B41F 7/24* (2013.01); *B41F 7/30* (2013.01)

(58) Field of Classification Search

CPC ..... B41F 7/24; B41F 31/28; B41P 2200/00; B41P 2235/26; B05B 1/00; B05D 2202/00; H04N 1/00567; B41J 11/009; B41J 11/004; B41J 27/00; B41N 3/08; F01D 1/20

USPC ..... 101/147, 132.5

See application file for complete search history.

(56) References Cited

U.S. PATENT DOCUMENTS

| | | | | |
|---|---|---|---|---|
| 2,753,796 | A * | 7/1956 | Wood et al. | 101/147 |
| 5,040,457 | A * | 8/1991 | Lin | 101/147 |
| 6,866,715 | B1 * | 3/2005 | Ruschak et al. | 118/211 |
| 7,117,788 | B2 * | 10/2006 | Blaney et al. | 101/147 |
| 2004/0011234 | A1 * | 1/2004 | Figov et al. | 101/488 |
| 2012/0103221 | A1 * | 5/2012 | Stowe et al. | 101/483 |

FOREIGN PATENT DOCUMENTS

| | | | |
|---|---|---|---|
| DE | 2629708 | A * | 7/1977 |
| JP | 63165143 | A * | 7/1988 |

* cited by examiner

*Primary Examiner* — Matthew G Marini

(74) *Attorney, Agent, or Firm* — Ronald E. Prass, Jr.; Prass LLP

(57) ABSTRACT

An ink-based digital printing system includes a dampening fluid delivery system that forms a dampening fluid layer on a reimageable surface of an imaging plate using vapor condensation. The system includes a delivery nozzle having a chamber that receives atomized dampening fluid, mixes the fluid with hot air or nitrogen gas for rapid vaporization, and directs the vapor onto an imaging member surface for condensation and dampening fluid layer formation.

20 Claims, 3 Drawing Sheets

SYSTEMS AND METHODS FOR INK-BASED DIGITAL PRINTING USING A VAPOR CONDENSATION DAMPENING FLUID DELIVERY SYSTEM

RELATED APPLICATION DATA

This application is related to co-pending U.S. patent application Ser. No. 13/426,262 to Liu et al., titled DAMPENING FLUID DEPOSITION BY CONDENSATION IN A DIGITAL LITHOGRAPHIC SYSTEM ("262 Application"), the disclosure of which is incorporated herein by reference in its entirety.

FIELD OF DISCLOSURE

The disclosure relates to ink-based digital printing. In particular, the disclosure relates to methods and systems for ink-based digital printing by depositing vaporized dampening fluid on an imaging member to form a sub-micron dampening fluid layer.

BACKGROUND

Related art ink-based digital printing systems, or variable data lithography systems configured for digital lithographic printing, include an imaging system for laser patterning a layer of dampening fluid applied to an imaging member having a reimageable surface. The dampening fluid layer is applied by splitting dampening fluid between a delivery roller and the imaging member surface, wherein the delivery roller contacts the imaging member surface. It is difficult to form a thin and uniform dampening fluid layer using related art dampening fluid application systems such as contact roller systems. Further, contact between the delivery roller and the imaging member surface causes ink contamination of the delivery roller, increased maintenance requirements, increased production costs, and decreased productivity.

SUMMARY

Systems and methods are desired for high speed ink-based digital printing that enable formation of a uniform dampening fluid layer of sub-micron thickness, and mid-process adjustment of dampening fluid layer thickness. Systems and methods of embodiments use a dampening fluid delivery system configured to pass vaporized fluid over an imaging member surface to achieve desired layer thickness.

In an embodiment, systems may include an ink-based digital printing system useful for ink printing, including an imaging member, the imaging member having a imaging surface; and a dampening fluid delivery system configured to direct vaporized dampening fluid onto the imaging surface, the vaporized dampening fluid being formed by mixing atomized dampening fluid with hot gas. The system may further include a nozzle chamber configured to receive the atomized dampening fluid at a first end, and configured to output the vaporized dampening fluid at a second end, chamber being configured to receive the hot gas for mixing with atomized fluid received at the first end.

The nozzle chamber may have an atomized dampening fluid input, and a heated gas input wherein the atomized dampening fluid mixes with the heated gas to form the vaporized dampening fluid; and a nozzle output configured to output dampening fluid vapor from the chamber. In an embodiment, a fan connected to the chamber, and configured to provide the hot gas to the chamber through the heated gas input. Vaporized dampening fluid may be forced by the hot gas from the chamber through the nozzle output.

In embodiment, systems may be configured to apply a dampening fluid layer having a thickness of 1 micrometer or less is formed on an imaging surface. In an embodiment, systems may include a filter configured to prevent liquid dampening fluid from exiting the chamber through the nozzle onto the imaging surface.

In an embodiment, the hot gas may be nitrogen. In an embodiment, the dampening fluid may be selected from the group consisting of silicone fluids, polyfluorinated ether, and fluorinated silicone fluid. Preferably, the dampening fluid may be selected from the group consisting of D4, D5, and OS20.

In another an embodiment, a dampening fluid delivery system may include a delivery nozzle having a chamber and a nozzle output; a heat source connected to the chamber for providing hot gas comprising air or nitrogen gas; and a dampening fluid source for providing atomized dampening fluid to the chamber whereby the atomized fluid and the hot gas mix to form dampening fluid vapor wherein the hot gas forces the vapor through the nozzle output. In an embodiment, systems may include a filter, the filter interposing the nozzle output and the heat source and dampening fluid source, and the filter being configured to prevent passage of liquid dampening fluid from the nozzle output. In an embodiment, systems may include the dampening fluid being selected from the group consisting of silicone fluids, polyfluorinated ether, and fluorinated silicone fluid.

In an embodiment, methods may include a method for ink-based digital printing, including providing atomized dampening fluid to a dampening fluid delivery nozzle chamber; mixing the atomized dampening fluid with hot gas to cause the dampening fluid to vaporize; and directing the dampening fluid vapor from the nozzle chamber onto a surface of an imaging member. In an embodiment, methods may include supplying the hot gas to the chamber using a fan. In methods, the hot gas being selected from the group consisting of air and nitrogen. The directing may include forcing vaporized dampening fluid onto the imaging member surface using the hot air supplied to the chamber. In an embodiment, the directing causes the vapor to condense at the imaging member surface for forming a dampening fluid layer on the imaging member surface, the dampening fluid layer having a thickness of 1 micrometer or less than 1 micrometer.

In an embodiment, the dampening fluid may be selected from the group consisting of silicone fluids, polyfluorinated ether, and fluorinated silicone fluid. In a preferred embodiment, the dampening fluid may be selected from the group consisting of D4, D5, and OS20.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
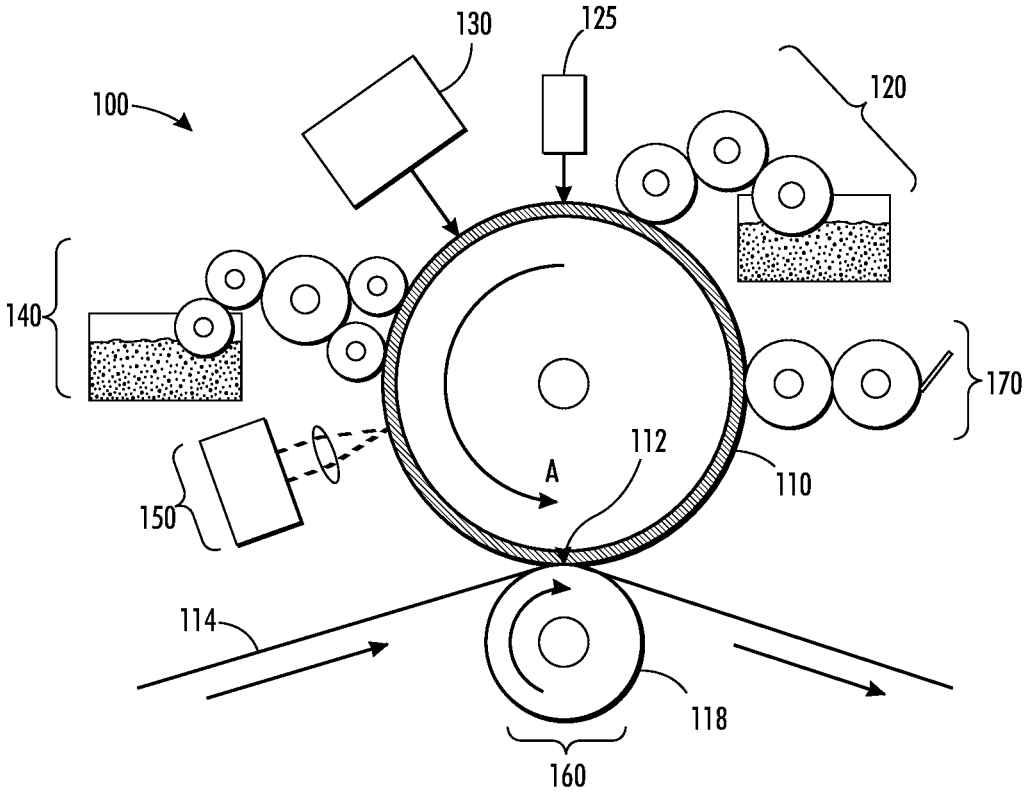
FIG. 1 RELATED ART
FIG. 1 shows an ink-based digital printing system having a related art fluid delivery system.

Exemplary embodiments are intended to cover all alternatives, modifications, and equivalents as may be included within the spirit and scope of the apparatus and systems as described herein.

Reference is made to the drawings to accommodate understanding of systems and methods for ink-based digital printing using a dampening fluid delivery system configured to apply a dampening fluid layer on an imaging member surface by vapor condensation. In the drawings, like reference numerals are used throughout to designate similar or identical elements. The drawings depict various embodiments of illustrative systems and methods for ink-based digital printing using a dampening fluid delivery system configured to vapor-deposit dampening fluid on a reimageable surface of an imaging member.

U.S. patent application Ser. No. 13/095,714 ("714 Application"), which is commonly assigned and the disclosure of which is incorporated by reference herein in its entirety, proposes systems and methods for providing variable data lithographic and offset lithographic printing or image receiving medium marking. The systems and methods disclosed in the 714 Application are directed to improvements on various aspects of previously-attempted variable data imaging lithographic marking concepts based on variable patterning of dampening fluids to achieve effective truly variable digital data lithographic printing.

According to the 714 Application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 714 Application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a plate or a belt, or another now known or later developed configuration. The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid subsystem 120 generally comprising a series of rollers, which may be considered as dampening rollers or a dampening unit, for uniformly wetting the reimageable surface of the imaging member 110 with dampening fluid. A purpose of the dampening fluid subsystem 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Suitable dampening fluids are disclosed, by way of example, in co-pending U.S. patent application Ser. No. 13/284,114, titled DAMPENING FLUID FOR DIGITAL LITHOGRAPHIC PRINTING, the disclosure of which is incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid subsystem 120.

Once a precise and uniform amount of dampening fluid is provided by the dampening fluid subsystem 120 on the reimageable surface of the imaging member 110, and optical patterning subsystem 130 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 Application. Briefly, the application of optical patterning energy from the optical patterning subsystem 130 results in selective evaporation of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife 175 may be employed to remove residual dampening fluid. It is anticipated, however, that some amount of ink residue may remain. Removal of such remaining ink residue may be accomplished through use of some form of cleaning subsystem 170. The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid subsystem 120 by which a fresh layer of dampening fluid is supplied to the reimageable surface of the imaging member 110, and the process is repeated.

According to the above proposed structure, variable data digital lithography has attracted attention in producing truly variable digital images in a lithographic image forming system. The above-described architecture combines the functions of the imaging plate and potentially a transfer blanket into a single imaging member 110 that must have a light absorptive surface.

It has been found that a dampening fluid delivery system such as system 120 shown in FIG. 1 cannot provide desired uniformity and sub-micron metering of dampening fluid to an imaging member surface, or uniform metering of a layer of dampening fluid that is 1.0 micrometers thick or less.

The 262 Application discloses systems for condensation-based dampening fluid delivery to a reimageable surface of a printing plate. The key requirement of the condensation-based dampening fluid subsystem of the 262 Application is to deliver a layer of dampening fluid having a relatively uniform and controllable thickness over a reimageable surface layer over an imaging member. In one embodiment this layer is in the range of less than 0.1 μm to 1.0 μm.

The dampening fluid must have the property that it wets and thus tends to spread out on contact with the reimageable surface. Depending on the surface free energy of the reimageable surface the dampening fluid itself may be composed mainly of water, optionally with small amounts of isopropyl alcohol or ethanol added to reduce its natural surface tension as well as lower the evaporation energy necessary for subsequent laser patterning. In addition, a suitable surfactant may be added in a small percentage by weight, which promotes a high amount of wetting to the reimageable surface layer. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally, the dampening fluid may contain a radiation sensitive dye to partially absorb laser energy in the process of patterning. Optionally the dampening fluid may be non-aqueous consisting of, for example, silicone fluids (such as D3, D4, D5, OS10, OS20 and etc.), polyfluorinated ether or fluorinated silicone fluid.

Due to the nature of vaporization-condensation process, the composition of the dampening fluid is preferred to have all the ingredients with relatively low boiling point (< about 250° C.). The non-aqueous dampening fluid options can take advantage of this invention readily because typically they do not need to have extra surfactant to enhance the wetting properties.

As discussed with reference to FIG. 1 described herein, there is no pre-formed hydrophilic-hydrophobic pattern on a printing plate in system 10. A laser (or other radiation source) is used to form pockets in and hence pattern the dampening fluid. The characteristics of the pockets (such as depth and cross-sectional shape), which determine the quality of the ultimate printed image, are in large part a function of the effect that the laser has on the dampening fluid. This effect is to a large degree influenced by the thickness of the dampening fluid at the point of incidence of the laser. Therefore, to obtain a controlled and preferred pocket shape, it is important to control and make uniform the thickness of the dampening fluid layer, and to do so without introducing unwanted artifacts into the printed image.

The 262 Application shows and describes a condensation-based dampening fluid subsystem having an Evaporative thickness control subsystem that is disposed proximate an imaging member having a reimageable surface. The condensation-based dampening fluid subsystem comprises a reservoir that contains an appropriate dampening fluid in liquid state. This dampening fluid may be converted into dampening fluid vapor by a number of different methods, such as heating the liquid state fluid to a boil by a heating element, such as resistive heating coils, radiation source (e.g., microwave), optical source (e.g., laser), conductive source (e.g., a heated fluid carried by conduit), or other methods. Dampening fluid in a vapor state may be transported from reservoir by a pump and conduit to a condensation region proximate reimageable surface. An ink-based digital lithographic printing system as described herein in FIG. 1 that is modified to include a condensation-based dampening fluid subsystem, or dampening fluid delivery system, is shown and described in the 262 Application at least with reference to FIG. 2 thereof, the disclosure of the 262 Application being incorporated herein by reference in its entirety.

It has been found that control over an amount of dampening fluid on the imaging member surface available for laser patterning is critical because the ink-based digital printing process requires that the plate reject and attract ink to form an image to be printed. As such, systems and methods in accordance with embodiments enable controlled formation of a layer of sub-micron thickness, plus or minus 5%. Further, a thin layer of dampening fluid enables a sharp image, minimized pullback, power savings, minimizes image defects, and minimize maintenance costs.

Figure 2:
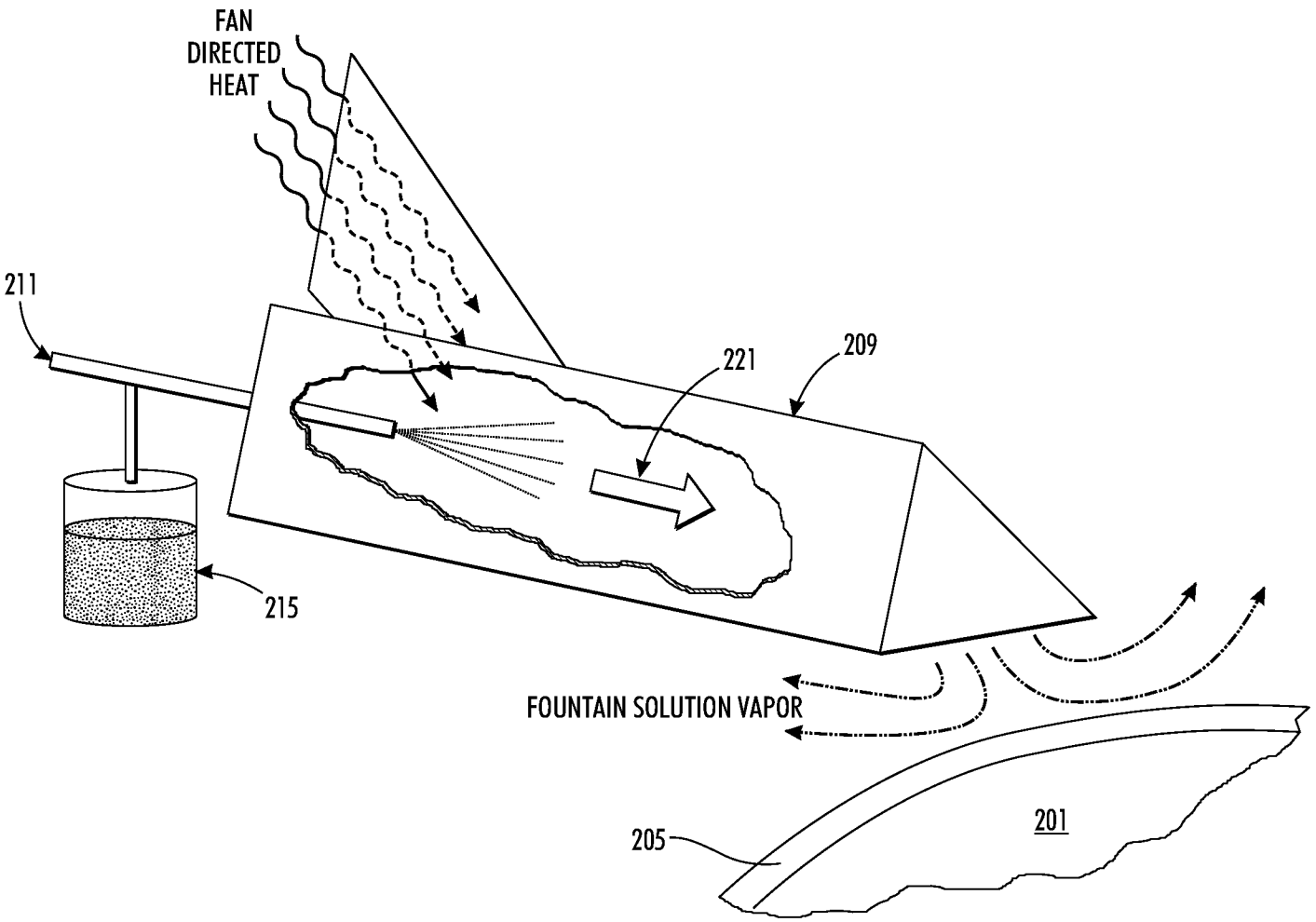
FIG. 2 shows a dampening fluid delivery system of an ink-based digital printing system in accordance with an embodiment.

FIG. 2 shows a dampening fluid subsystem, or dampening fluid delivery system configured for condensation-based dampening fluid delivery, or more particularly, vapor condensation. In particular, FIG. 2 shows an imaging member 201 having a reimageable surface layer 205. A delivery nozzle chamber 209 of a dampening fluid delivery system is positioned to output dampening fluid vapor (shown by way of example as fountain solution vapor) onto the surface 205 of the imaging member 201. An atomizing nozzle 211 is configured to pass dampening fluid from a supply 215 to an interior of the nozzle chamber 209. The dampening fluid is atomized by the atomizing nozzle 211 and directed into the chamber 209.

The dampening fluid delivery nozzle is configured to accept heat directed into the nozzle chamber 209. For example, fan directed heat may be provide to an interior of the chamber 209. In particular, heated gas is directed into the chamber to mix with the atomized dampening fluid thereby forming dampening fluid vapor, which proceeds in the direction of arrow 221 for output onto the imaging member surface 205. The heated gas may be in the form of heated air, or nitrogen to reduce fire hazard. The heat is of a temperature sufficient to transform the atomized dampening fluid to a vapor to be pushed out of the nozzle chamber 209 by the force of the heated air flow. In principle, the heated air can be brought in at any temperature significantly higher than the temperature of the imaging member. In practice, when D4 is used as the dampening fluid, to avoid fire hazard and to efficiently use the heat energy, hot air can be injected into the chamber at 70 C~300 C. In a preferred embodiment, the hot air can be at 150~250 C. A large surface area of contact between the atomized dampening fluid droplets and hot air allows for rapid vaporization, and the chamber of the delivery nozzle is configured to accommodate a large surface area of contact between atomized dampening fluid and introduced heated gas. During the mixing of the hot air and the atomized dampening fluid and the subsequent vaporization of the dampening fluid, the temperature of the air will drop significantly. The temperature of the vapor-rich air at the exit of the chamber is preferred to be 50~100 C and the vapor concentration in the air should be close the saturation level at the corresponding temperature. When the heated vapor exits the chamber 209, the vapor contacts the cooler imaging member surface 205 and condenses to and forms a fluid layer on the imaging member surface 205. In some embodiments, the chamber 209 may include a filter at the nozzle output for preventing un-vaporized dampening fluid droplets from reach the imaging member surface 205.

Control over layer formation can be influenced by factors including: velocity and pressure of heated air; rate of flow of atomized dampening fluid; temperature of heated air; and the temperature delta of the vapor cloud to the imaging member surface 205. A layer of less than one micrometer of thickness is required for sharp (no pullback) imaging of the dampening fluid by the laser of the optical patterning system while maintaining sufficient thickness to reject ink where not ablated. Also, related art solutions to addressing excess fluid are insufficient even with use of squeegee or evaporation subsystems, which cause unevenness of the layer.

Methods and dampening fluid delivery systems of embodiments enable precise and even deposition of dampening fluid that does not require further thinning or leveling before imaging. The lack of mechanical contact reduces a potential for ink contamination of the delivery system, reduces maintenance. Further because the dampening fluid is directly atomized into the vapor stream, the response of the delivery system to reduce or increase deposition rate is faster than roller-type systems that must rely on over-filling a metering nip and smoothing by additional rolls whereby excess or lack of dampening fluid must first propagate through the entire system of nips and rolls.

Figure 3:
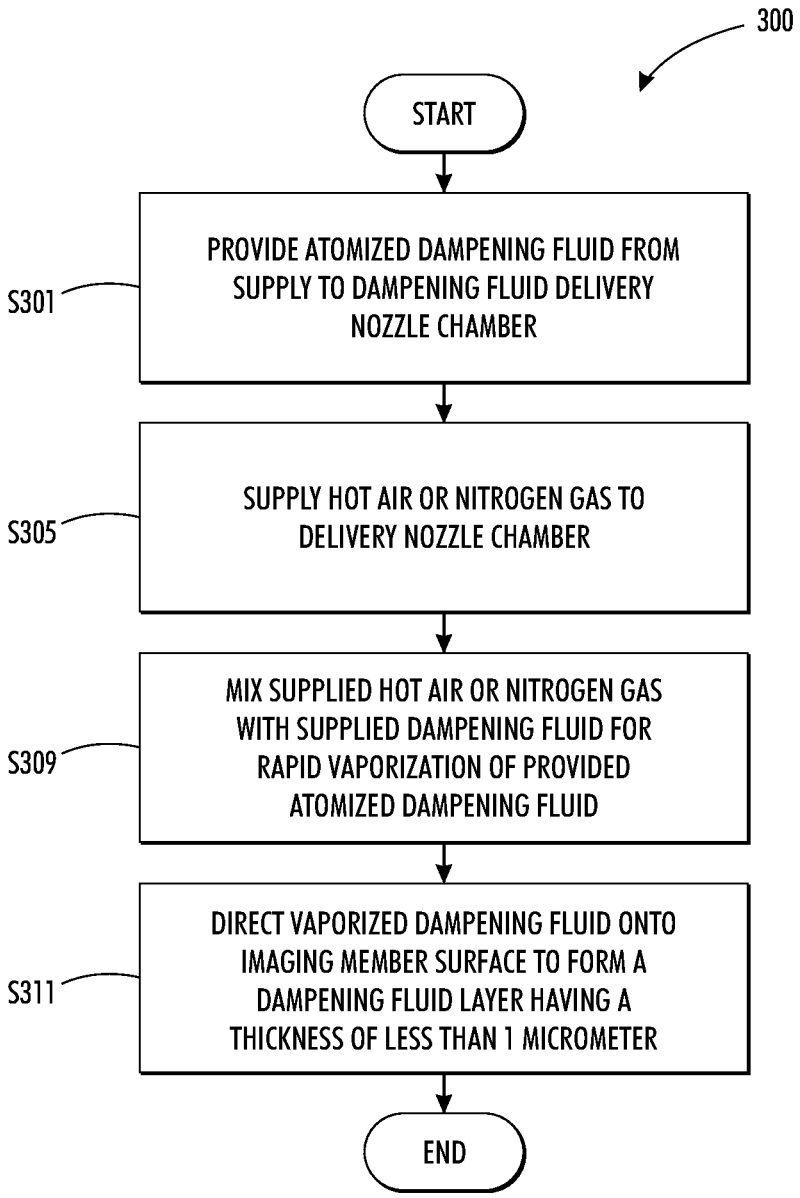
FIG. 3 shows a methods for ink-based digital printing system in accordance with an embodiment.

FIG. 3 shows methods 300 for ink-based digital printing using a variable data lithography printing system having a dampening fluid delivery system configured for vapor condensation in accordance with an embodiment. Methods may include providing at S301 atomized dampening fluid, or, e.g., fountain solution, from a fluid supply to a dampening fluid delivery nozzle chamber. The atomized dampening fluid may be provided by known or later developed methods including ultrasonic, spray, air jet, mist, and inkjet.

Hot air is supplied at S305 to the chamber of the dampening fluid delivery nozzle. The hot air should be of a temperature sufficient to cause vaporization of the atomized dampening fluid. For example, when D4 is used as the dampening fluid, the hot air may be provided to the delivery chamber at a temperature of 70~300 C, a fan may be connected to the nozzle chamber and configured to direct hot air into the chamber that has been provided with atomized air at S301. The atomized dampening fluid is mixed with the supplied hot air at S309 to cause rapid vaporization of the atomized dampening fluid.

The delivery nozzle is configured so that the hot air flow forces the vaporized dampening fluid from the dampening fluid delivery chamber to the imaging member surface at S311. The dampening fluid vapor condenses on the cooler imaging member surface, forming a layer of a thickness less than 1 micrometer as desired. In alternative embodiments, the heated nitrogen gas may be directed into the delivery nozzle for mixing with the atomized dampening fluid. Nitrogen gas may be used instead of, e.g., air to minimize fire hazard.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing system useful for ink printing, comprising:

an imaging member, the imaging member having an imaging surface;

a dampening fluid delivery system configured to direct vaporized dampening fluid directly onto the imaging surface to form a dampening fluid layer on the imaging surface, the vaporized dampening fluid being formed by mixing atomized dampening fluid with hot gas; and a nozzle chamber configured to receive the atomized dampening fluid from an atomizing nozzle at a first end of the nozzle chamber, and configured to output the vaporized dampening fluid at a second end, the chamber being configured to receive the hot gas for mixing with the atomized dampening fluid received at the first end, the hot gas being received by the chamber at a location separate from the first end, wherein the hot gas is heated at a location outside of the nozzle chamber.

2. The system of claim 1, the dampening fluid system further comprising:

a nozzle output configured to output the vaporized dampening fluid from the chamber at the second end.

3. The system of claim 2, further comprising:

a fan connected to the chamber, and configured to provide the hot gas to the chamber through a heated gas input.

4. The system of claim 3, the vaporized dampening fluid being forced by the hot gas from the chamber through the nozzle output.

5. The system of claim 4, comprising:

a filter configured to prevent liquid dampening fluid from exiting the chamber through the nozzle.

6. The system of claim 1, whereby the dampening fluid layer has a thickness of 1 micrometer or less.

7. The system of claim 1, the dampening fluid further comprising the dampening fluid selected from the group consisting of silicone fluids, polyfluorinated ether, and fluorinated silicone fluid.

8. The system of claim 1, the dampening fluid comprising silicone fluid selected from the group consisting of D4, D5, and OS20.

9. The system of claim 1, wherein the nozzle chamber is fluidly connected to all supplies of the dampening fluid by only the atomizing nozzle.

10. An ink-based digital printing system useful for ink printing, comprising:

an imaging member, the imaging member having an imaging surface;

a dampening fluid delivery system configured to direct vaporized dampening fluid directly onto the imaging surface to form a dampening fluid layer on the imaging surface, the vaporized dampening fluid being formed by mixing atomized dampening fluid with hot gas; and a nozzle chamber configured to receive the atomized dampening fluid at a first end, and configured to output the vaporized dampening fluid at a second end, the chamber being configured to receive the hot gas for mixing with the atomized dampening fluid received at the first end, wherein the hot gas is nitrogen, and the hot gas is heated at a location outside of the nozzle chamber.

11. A dampening fluid delivery system, comprising:

a delivery nozzle having a chamber and a nozzle output, the chamber having a first end and a second end;

a heat source connected to the chamber for providing hot gas comprising air or nitrogen gas to the chamber, the heating source being located outside of the nozzle chamber; and a dampening fluid source separate from the heat source for providing atomized dampening fluid to the chamber at the first end whereby the atomized fluid and the hot gas mix in the chamber to form dampening fluid vapor, the hot gas being received by the chamber at a location separate from the first end, wherein the hot gas forces the vapor out of the chamber through the second end and then through the nozzle output.

12. The system of claim 11, comprising:

a filter, the filter interposing the nozzle output and the heat source and dampening fluid source, and the filter being configured to prevent passage of liquid dampening fluid from the nozzle output.

13. The system of claim 11, the dampening fluid further comprising the dampening fluid selected from the group consisting of silicone fluids, polyfluorinated ether, and fluorinated silicone fluid.

14. A method for ink-based digital printing, comprising:

providing atomized dampening fluid to a dampening fluid delivery nozzle chamber at a first end of the nozzle chamber;

providing hot gas to the nozzle chamber at a location separate from the first end;

mixing the atomized dampening fluid with the hot gas in the nozzle chamber to cause the dampening fluid to vaporize;

outputting the vaporized dampening fluid at a second end of the nozzle chamber; and directing the dampening fluid vapor from the nozzle chamber directly onto a reimageable surface of an imaging member, wherein the directing causes the vapor to condense at the reimageable surface of the imaging member for forming a dampening fluid layer on the reimageable surface of the imaging member, and the hot gas is heated at a location outside of the nozzle chamber.

15. The method of claim 14, comprising:

supplying the hot gas to the chamber using a fan.

16. The method of claim 14, the hot gas being selected from the group consisting of air and nitrogen.

17. The method of claim 14, the directing further comprising:

forcing vaporized dampening fluid directly onto the imaging member surface using the hot gas supplied to the chamber.

18. The method of claim 14, wherein the dampening fluid layer has a thickness of 1 micrometer or less than 1 micrometer.

19. The method of claim 14, the dampening fluid further comprising the dampening fluid selected from the group consisting of silicone fluids, polyfluorinated ether, and fluorinated silicone fluid.

20. The method of claim 14, the dampening fluid comprising silicone fluid selected from the group consisting of D4, D5, and OS20.

* * * * *